US005971695A

United States Patent [19]

Batzer et al.

[11] Patent Number: 5,971,695

[45] Date of Patent: Oct. 26, 1999

[54] TURNER WITH ADJUSTABLE FEED MEANS

[75] Inventors: Josef Batzer, Stadtbergen; Karlheinz Eberl, Kühlenthal, both of Germany

[73] Assignee: Bowe Systec AG, Augsburg, Germany

[21] Appl. No.: 09/000,404

[22] PCT Filed: Feb. 13, 1997

[86] PCT No.: PCT/EP97/00679

§ 371 Date: Jan. 29, 1998

§ 102(e) Date: Jan. 29, 1998

[87] PCT Pub. No.: WO97/30920

PCT Pub. Date: Aug. 28, 1997

[30] Foreign Application Priority Data

Feb. 23, 1996 [DE] Germany ..... 196 06 887

[51] Int. Cl.[6] ..... B65G 47/22

[52] U.S. Cl. ..... 414/765; 414/766; 198/403

[58] Field of Search ..... 198/402, 403, 198/404; 271/65, 185, 186; 414/754, 764, 765, 766

[56] References Cited

U.S. PATENT DOCUMENTS

| | | | |
|---|---|---|---|
| 3,071,258 | 1/1963 | Seigh et al. | 198/403 |
| 3,547,279 | 12/1970 | Radomski | 414/765 |
| 4,354,788 | 10/1982 | Giusti | 414/763 |

FOREIGN PATENT DOCUMENTS

| | | |
|---|---|---|
| 310 639 | 10/1973 | Austria . |
| 71.41740 | 7/1973 | France . |
| 867 520 | 2/1953 | Germany . |
| 1953525 | 11/1970 | Germany . |
| 2039 116 | 2/1972 | Germany . |
| 23 43856 A 1 | 3/1975 | Germany . |
| 31 15925 C 1 | 12/1982 | Germany . |
| 32 14457 A 1 | 10/1983 | Germany . |
| 3303672 C 2 | 8/1984 | Germany . |
| 3703951 A 1 | 8/1988 | Germany . |
| 3-96562 | 11/1992 | Japan . |
| 3-296516 | 4/1993 | Japan . |
| 2 202 207 | 9/1988 | United Kingdom . |

*Primary Examiner*—Janice L. Krizek
*Assistant Examiner*—Gregory A Morse
*Attorney, Agent, or Firm*—Duft, Graziano & Forest, P.C.

[57] ABSTRACT

A turning device for turning paper material has a reception tray used for receiving therein the material to be turned and arranged such that it is adapted to be rotated about an axis of rotation. The material is arranged in said reception tray in such a way that its axis of inertia during turning substantially coincides with the axis of rotation of said reception tray. A feeder is provided for feeding the material into the reception tray in the direction of the axis of rotation. A removing device withdraws the material from the reception tray in the direction of the axis of rotation. When seen in a direction of transport of the material, the feeder is arranged at an adjustable distance ahead of the reception tray. The removing device is arranged at a fixed distance behind the reception tray, when seen in the direction of transport of the material.

12 Claims, 3 Drawing Sheets

TURNER WITH ADJUSTABLE FEED MEANS

BACKGROUND OF THE INVENTION

1. Field of the Invention

The present invention refers to a turning device, especially to a turning device for paper, of the type used e.g. in paper handling systems.

Paper handling systems making use of a turning device are primarily used by large enterprises, banks, insurance companies, service-rendering enterprises, etc. In these enterprises, the paper handling systems serve to process large amounts of paper, such as invoices, reminders, statements of account and the like.

2. Description of Prior Art

These paper handling systems use different devices for turning the paper which are known from the prior art.

A first device used according to the prior art for the purpose of turning paper turns the paper in a helical movement during transport. This kind of turning is effected by guiding the paper helically and is also referred to as helical turning. A disadvantage of such helical turning of the paper during transport is to be seen in the fact that long paths are necessary because the paper is wound during turning. When a thick object, such as a stack of paper or a pack, is to be processed, the turning path must be dimensioned in accordance with the admissible winding. In the case of loose, thick packs the act of winding results in slipping or displacement of the object to be turned in itself and this may make further processing more difficult or prevent such further processing. Another disadvantage is that, due the long transport paths, several objects will move along the turning path in most cases, and this may cause collisions in the turning path when stagnation occurs during processing in the follow-up device, since the turning path is provided with permanent drives and can therefore not be stopped within a sufficiently short period of time. Still another problem arises when mixed processing of individual sheets and of thick packs consisting of several sheets is carried out, since guiding problems will then arise due to the resultant vertical movement of the transport belts so that, in the case of a narrow sequence, the thinner object located between a preceding thicker object and a subsequent thicker object is not guided firmly enough and will therefore slip between the conveyor belts. This type of turning path is also disadvantageous insofar as it does not offer the possibility of selecting between turning and non-turning. If the way in which the paper is processed does not require any turning operation, the turning path will have to be replaced by a feed-through path in this case, i.e. it will be necessary to remove the turning device from the paper handling system and to install the feed-through path in the paper handling system.

Another device used according to the prior art is a turning wheel comprising a plurality of trays. In such a turning wheel several trays, which serve to accommodate the material to be turned, are normally arranged such that they extend in a starshaped mode of arrangement towards the centre of rotation of the turning wheel. The disadvantage of this turning wheel is that a large turning diameter is required, which, in turn, results in a large overall size. Another disadvantage is that, when the turning wheel is used, a large lateral displacement between the input and the output of the turning wheel will occur when the material is being turned, and this will, in turn, enlarge the width of the overall size. Still another disadvantage is that, due to the large turning circle of the turning wheel, high moments of inertia have to be overcome during acceleration and deceleration of the turning wheel, and this necessitates a high driving power. A further disadvantage is that this kind of turning device does not offer the possibility of selecting between turning and non-turning either. If the way in which the paper is processed does not require any turning operation, it will again be necessary to replace the turning wheel by a feed-through path with deflection points.

AT 310639 refers to a turning device for turning clay bodies of the type shown in detail on the basis of FIGS. 1 and 2 thereof. From AT 310639 it is known to provide a turning device having provided therein a reception tray into which a clay body can be introduced such that its axis of rotation substantially coincides with the axis of rotation of the reception tray. Furthermore, rollers are provided, which serve to introduce the clay body in and to remove it from the turning device.

FR 2161320 refers to a turning device for turning plate-shaped elements, which comprises a reception tray into which the plates are introduced, the axis of rotation of the plates essentially coinciding with the axis of rotation of the reception tray also in this case. Furthermore, feed means and removal means are provided for feeding the plates to be turned to the turning device and for removing the turned plates from the turning device.

DE 37 03 951 A1 refers to a turning device for stacks of paper, which is arranged between a feed means and a discharge means. Two pressure jaws for holding the stack of paper are provided, said pressure jaws being floatingly supported on guide means and having associated therewith defined stop means so that the respective lower pressure jaw will always be adjusted automatically to the feed and discharge level of the feed means of the discharge means, respectively.

SUMMARY OF THE INVENTION

It is the object of the present invention to provide a simplified, small-size turning device by means of which objects introduced therein can selectively be turned or not turned.

This object is achieved by a turning device, especially for turning paper material, comprising

- a reception tray used for receiving therein the material to be turned and arranged such that it is adapted to be rotated about an axis of rotation, the material being arranged in said reception tray in such a way that its axis of inertia during turning substantially coincides with the axis of rotation of said reception tray;
- a means for feeding the material into the reception tray in the direction of the axis of rotation; and
- a means for removing the material from the reception tray in the direction of the axis of rotation;
- wherein, when seen in a direction of transport of the material, the feed means is arranged at an adjustable distance ahead of the reception tray, and, when seen in the direction of transport of the material, the removal means is arranged at a fixed distance behind the reception tray.

The advantage of the present invention is that it can be used for turning a thin object as well as for turning a loose thick object, the radii of rotation being very small due to the turning about the axis of rotation of the object. This guarantees a small overall size and, consequently, a small necessary driving power.

A further advantage of the present invention is that the inlet in and the outlet from the turning device are located on one line of movement and that no lateral displacement occurs during turning.

According to a preferred embodiment, the reception tray of the turning device is centrally divided such that two trays are formed, the upper tray being used for feeding the material in question and the lower tray for removing said material, the two trays changing positions due to the turning operation so that the tray which has initially been used for feeding the material in question will be used for removing the material after the turning operation, and the tray which has initially been used for removing the material will serve as the tray into which the material is fed after the turning operation.

According to a further preferred embodiment, the feed means is arranged at an adjustable distance ahead of the reception tray when seen in a direction of transport of the material, and the removal means is arranged at a fixed distance behind the reception tray when seen in the direction of transport of the material. This offers the advantage that, due to the adjustability of the distance between the feed means and the reception tray, different formats can be handled by the turning device.

Preferred further developments of the present invention are defined in the subclaims.

BRIEF DESCRIPTION OF THE DRAWINGS

Preferred embodiments of the present invention will be explained in detail hereinbelow with reference to the drawings enclosed, in which.

DESCRIPTION OF PREFERRED EMBODIMENTS OF THE INVENTION

Figure 1:
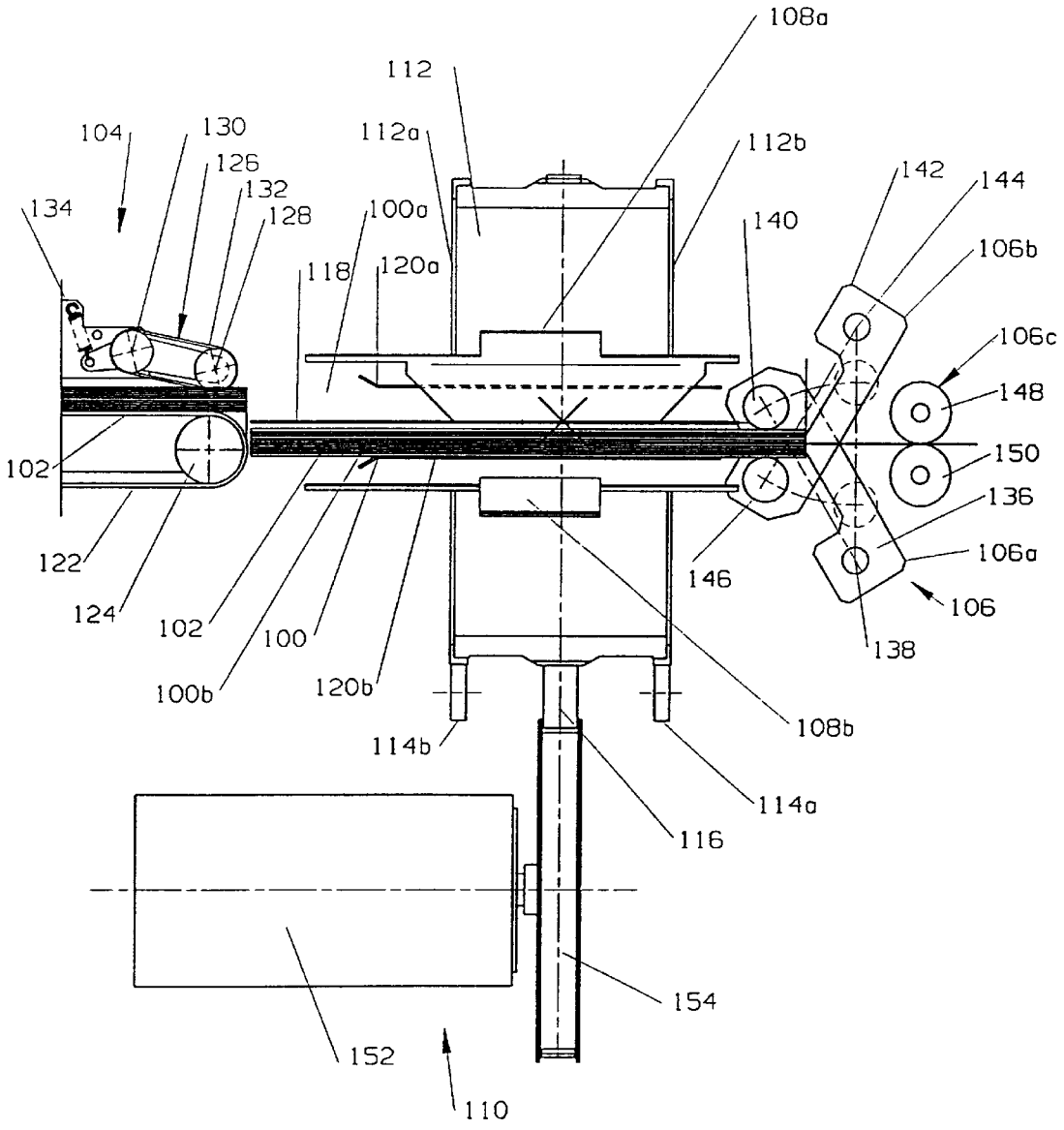
FIG. 1 shows a representation of a longitudinal section through the turning device according to the present invention in the direction of transport.

In the description of the preferred embodiments of the present invention on the basis of the enclosed drawings following hereinbelow, identical reference numerals are used for corresponding elements in the various drawings.

The turning device according to the present invention is used e.g. in a paper handling system in which envelopes filled with documents or with printed matter have to be turned after the filling operation so as to permit said envelopes to be franked. In the case of such an example, the device according to the present invention will then be positioned ahead of the franking device. Another example of how the turning device according to the present invention is used are preprinted forms which are to be printed on both sides, e.g. forms onto which customer-specific information has to be introduced on the front and on the back. The turning device according to the present invention is then provided between the two printers introducing this information so that both sides of the documents can be printed on.

In FIG. 1, a first embodiment of the turning device according to the present invention is shown in a representation showing a longitudinal section in the direction of transport. The direction of transport extends in FIG. 1 from the left to the right.

The turning device according to the present invention comprises a reception tray 100 which is supported such that it is rotatable about an axis of rotation (not shown in FIG. 1). A material to be turned 102 is arranged in said reception tray 100 in such a way that its axis of inertia during turning substantially coincides with the axis of rotation of the reception tray 100. The turning device according to the present invention additionally comprises means, designated generally by reference numeral 104, which are used for feeding the material in the reception tray 100 in the direction of the axis of rotation. Means, designated generally by reference numeral 106, serve to remove the material from the reception tray 100 in the direction of the axis of rotation. In FIG. 1, holding means are provided, which consist of two holding elements 108*a*, 108*b* and which hold the material 102 when it is being turned in the reception tray 100. The structural design of the holding elements 108*a*, 108*b* will be explained in detail hereinbelow on the basis of FIG. 2. The turning device additionally comprises a drive means 110 operatively connected to the reception tray 100 so as to rotate the same.

A drumshaped element 112 is provided, in which the reception tray 100 is arranged such that the axis of rotation of said reception tray 100 coincides with an axis of rotation of the drumshaped element 112. The drumshaped element 112 is constructed such that the reception tray 100 projects beyond the two end faces 112*a* and 112*b* of said drumshaped element 112 in the direction of the axis of rotation. The holding elements 108*a*, 108*b* are arranged within the element 112 and, in the embodiment shown in FIG. 1, they project partly beyond the end faces 112*a* and 112*b*. The drumshaped element 112 is supported by bearings 114*a* and 114*b* and it is connected to the drive means 110 via a belt 116. Due to the use of a drumshaped element 112, the turning device shown in FIG. 1 is also referred to as turning drum.

The feed means 104 is arranged at a distance ahead of the reception tray 100 when seen in the direction of transport of the material. The distance between the feed means 104 and the reception tray 100 can be adjusted, whereas the removal means 106 is arranged at a fixed distance from the reception tray 100. This combination permits the turning drum to handle different sizes and formats of the material to be turned. A new format is adjusted simply by enlarging or reducing the distance between the feed means 104 and the reception tray 100. In order to guarantee that the turned material is removed from the reception tray 100, the distance between the removal means 106 and the reception tray 100 must be constant and invariable.

The turning drum shown in FIG. 1 comprises a reception tray 100 which is subdivided into a first tray 100*a* and a second tray 100*b*; in FIG. 1, the material 102 is shown at a position at which it is arranged in tray 100*b*. Tray 100*a* is in alingment with the feed means 104 so that the material to be turned is fed into said tray 100*a* of the reception tray 100. Tray 100*b* is in alignment with the removal means 106 so that the material turned can be removed from the reception tray 100. When the turning drum is in operation, i.e. during a turning process, the trays 100*a* and 100*b* exchange positions so that the original tray 100*a*, into which the material was introduced, will become tray 100*b*, from which the turned material is removed, after the turning process. Tray 100*b*, from which the turned material was removed prior to carrying out the next turning process, will become tray 100*a* after the turning process, which has introduced therein the new material to be turned. Tray 100*a* is separated from tray 100*b* by an intermediate plate 118.

In order to guarantee that the material to be turned is reliably introduced into the tray which constitutes part of the reception tray 100 and which is in alignment with the feed means 104, tray 100*a* as well as tray 100*b* are both provided with a guide plate 120*a*, 120*b*. Reference is made to the fact that the guide plates 120*a* and 120*b* may also be provided in a reception tray 100 which is not subdivided.

In FIG. 1 part of a feed means 104 is shown; said feed means 104 will be described in detail hereinbelow. The feed means 104 comprises a conveyor belt 122 guided over a roller 124 and driven in a suitable manner (not shown). On the conveyor belt 122, the material 102 to be turned is moved in the direction of transport and introduced in the reception tray 100 of the turning drum. A hold-down device 126 comprises first and second guide rollers 128, 130 around which a belt 132 runs. The hold-down device 126 is spring-biased relative to the conveyor belt 122 by means of a spring 134. The material 102 passes between the conveyor belt 122 and the hold-down device 126 while pressure is being applied to said material 102 by said hold-down device 126. The belt 132 of the hold-down device 126 is entrained by the movement of the material 102 without being driven itself.

The removal device 106 essentially comprises three elements, a first engagement member 106*a*, a second engagement member 106*b*, and a discharge means 106*c*. The first engagement member 106*a* consists of an elongate component 136 which is rotatably supported at one end 138 thereof. At the end located opposite the bearing 138, a driven roller 140 is provided, which will engage a turned material 102, arranged in tray 100*b*, when said component 136 is pivoted from a first position to a second position, said first position being shown by a broken line in FIG. 1.

The second engagement member 106*b* has essentially the same structural design as the first engagement member 106*a* and comprises an elongate member 142. One end 144 of component 142 is rotatably supported and a driven roller 146 is provided at the end of component 142 that is located remote from the bearing 144, said roller 146 engaging the turned material 102 when said component 142 is pivoted from a first position, which is again shown by a broken line, to a second position. The engagement by means of said members 106*a*, 106*b* takes place in FIG. 1 in such a way that the first member 106*a* engages a first surface of the turned material and that the second member 106*b* engages a second surface of said turned material, said second surface being located opposite said first surface. After having engaged the turned material, the engagement members 106*a*, 106*b* convey said material in the direction of the discharge means 106*c*. The discharge means comprises two rollers 148 and 150, at least one of said rollers being driven, and advances the turned material to a subsequent station for further processing.

The drive means 110 comprises a motor 152, the output shaft of which has a pulley 154 secured thereto, the belt 116 being guided round said pulley.

In the following, the operation of the turning drum shown in FIG. 1 will be explained in detail. When said turning drum is in operation, the material 102 is introduced into the upper tray 100*a* of the reception tray 100 by the feed means 104, and a material which may perhaps be contained in the turning drum in the lower tray 100*b* is removed simultaneously. The removal from the turning drum is carried out by means of the engaging components 136 and 142 of the removal means 106, which are adapted to be pivoted into and out of the area of the turning drum, whereby the material 102 is transferred to the discharge means 106*c* for further transport. The pivot-in and pivot-out periods are very short.

In the turning drum, the material 102 is located in a tray where it is held by means of the holding elements 108*a*, 108*b* during the turning process. If e.g. full envelopes are turned round, the holding elements 108*a*, 108*b* are adapted to apply pressure to the moist flap and to keep it closed. Depending on the structural design of the holding elements 108*a*, 108*b*, said holding elements are either controlled actively outside of the turning drum or they define a passive system. As has already been mentioned, the feed means 104 is adapted to be adjusted so that the distance between the turning drum and said feed means 104 is adjusted in dependence upon the different format lengths, and this guarantees that, in the case of different formats of the material, said material will always abut on the same format edge relative to the removal means 106.

One advantage of the turning drum described on the basis of FIG. 1 is to be seen in the fact that, in cases in which turning of the material is not necessary, said turning drum can also be set to a mode of operation in the case of which no turning process takes place. In other words, the turning drum is adjusted in a first mode of operation such that the material introduced in the reception tray 100 is turned and in a second mode of operation such that it acts as a feed-through path, i.e. that the material introduced is not turned. In the embodiment shown in FIG. 1, the removal means 106 is mechanically aligned with the first tray 100*a* of the reception tray 100 for adjusting the feed-through path mode of operation, and the turning drum is in this case controlled by a control means, which is not shown, such that the turning function is not carried out.

If the turning drum described on the basis of FIG. 1 is used in a paper handling system, the material to be turned comprises e.g. paper, single sheets, loose packs of paper and envelopes with or without content.

Figure 2:
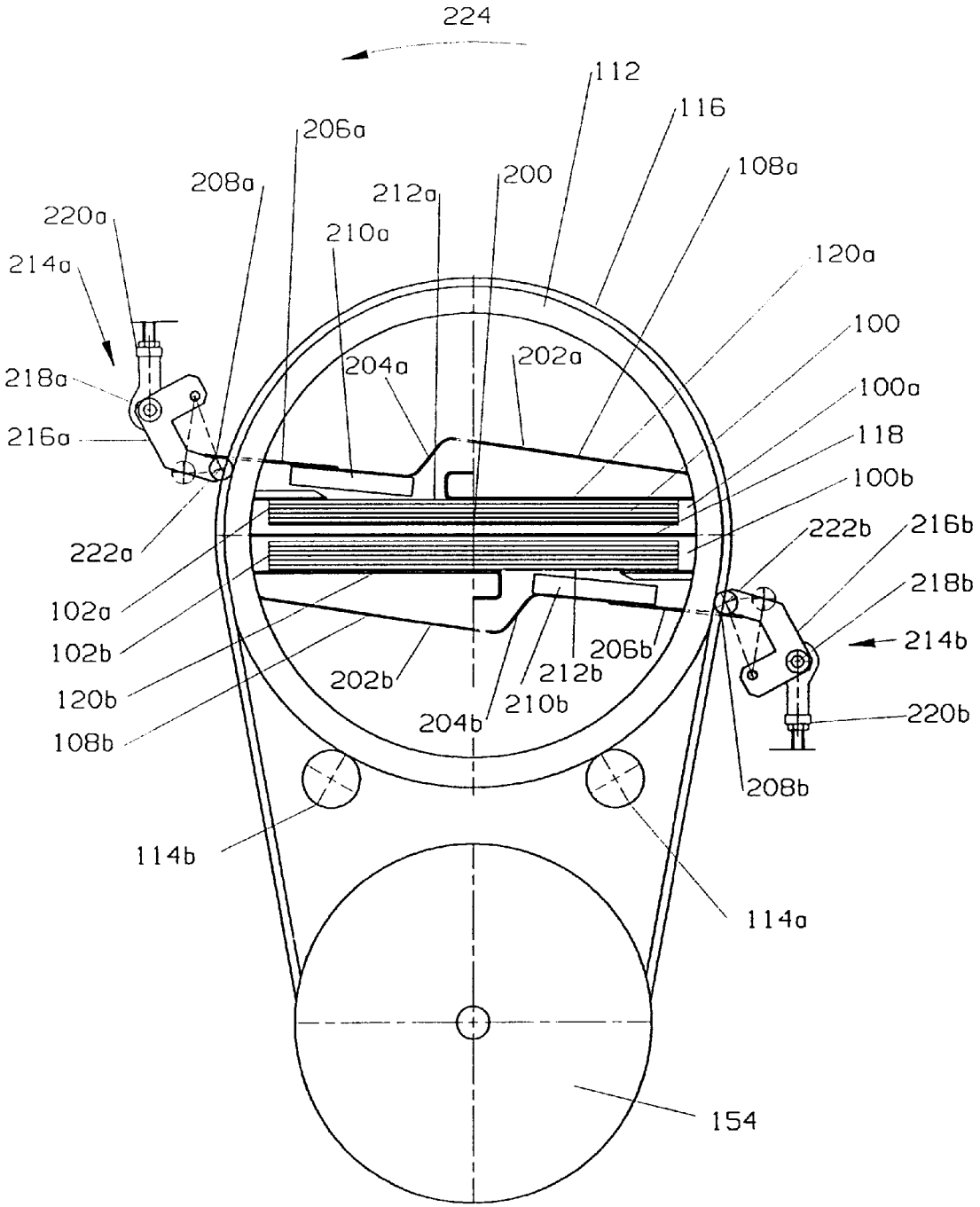
FIG. 2 shows a cross-sectional representation of the embodiment shown in FIG. 1.

In the following, the mode of operation of the holding elements 108*a*, 108*b* is explained in detail on the basis of FIG. 2, which shows a cross-sectional representation of the turning drum shown in FIG. 1. Elements which have already been described on the basis of FIG. 1 are designated by the same reference numerals in FIG. 2. In order to explain the mode of operation of the holding means more clearly, the two trays 100*a* and 100*b* of the reception tray 100 are shown in FIG. 2 in a condition in which they are filled with a material 102*a* and 102*b*.

On the basis of the FIG. 1, it has been described that, when the material is being turned, the axis of inertia of the material during turning substantially coincides with the axis of rotation of the reception tray. In FIG. 2, the axis of rotation of the reception tray is designated by reference numeral 200. This axis of rotation coincides with the axis of rotation of the drumshaped element 112.

In the following, the holding elements 108*a*, 108*b* are described in detail; to make things easier, only element 108*a* is described. Element 108*b* has the same structural design as element 108*a*, and the reference numerals used in connection with said element 108*b* correspond to those used in connection with element 108*a*, the only difference being that they have added thereto the letter b.

The holding element 108*a* comprises three sections 202*a*, 204*a* and 206*a*. Section 202*a* is secured to the drum 112 at a point adjacent an edge portion of the reception tray 100. Said section 202*a* extends into the interior of the drum 112, the distance between said section 202*a* and the guide plate 120*a* of the reception tray 100 increasing along the length of said section 202*a*. In the embodiment shown in FIG. 2, said section 202*a* extends beyond the centre of the drum 112 and, adjacent said centre of the drum 112, it merges with section 204*a* whose point of connection to said section 202*a* is located farther away from the guide plate 120*a* of the reception tray 100 than the point where said section 204*a* merges with section 206*a*. Section 206*a* extends from section 204*a* beyond the outer circumference of the drum 112, whereby a projection 208*a* is defined. Along the length of said section 206*a*, the distance between the guide plate 120*a* and said section 206*a* increases from the point of connection between sections 204*a* and 206*a*. An engagement portion 210*a* is secured to section 206*a* adjacent the point where said section 204*a* merges with section 206*a*. By means of the above-mentioned structure of element 108*a*, said element is pretensioned in the direction of the reception tray 100 so that, when a material is contained in said reception tray 100, the engagement portion 210*a* will be pressed onto said material. In order to permit an engagement, the guide plate 120*a* is provided with an opening 212*a* through which said engagement portion 210*a* is brought into engagement with the material 102.

Reference is made to the fact that the holding element 108*b* has the same structural design as the holding element 108*a*; it is, however, arranged in a mirror-inverted mode of arrangement so that the the symmetry of the turning drum is not influenced.

Adjacent the outer peripheral surface of the drum 112, two hold-back means 214*a* and 214*b* are provided, which have the same structural design and which engage the projections 208*a* and 208*b* of the holding elements 108*a* and 108*b*. These hold-back means are now described making reference to means 214*a*; the reference numerals used for the hold-back means 214*b* correspond to those used for said means 214*a*, the only difference being that they have added thereto the letter b. The hold-back means 214*a* comprises an angular component 216*a* which is rotatably supported at one end 218*a* thereof, the bearing being formed on a fastening member 220*a*. The hold-back means is adapted to be pivoted to two positions; at the first position, which is shown by a broken line in FIG. 2, engagement with the projection 208*a* does not take place. At the second position, a roller 222*a* abuts on the outer surface of the drum 112 and comes into engagement with the projection 208*a* when the drum 112 rotates in the direction indicated by arrow 224.

When the turning drum is at the position shown in FIG. 2, the hold-back means 214*a* and 214*b* engage the projections 208*a* and 208*b* whereby the engagement between sections 210*a* and 210*b* and the material 102*a* and 102*b* contained in the reception tray 100 is released so that said material can be fed into and removed from said reception tray 100 without being obstructed by the holding elements 108*a* and 108*b*. As soon as the feeding and the removal of the material have been finished, the turning drum is rotated and, simultaneously, the hold-back means 214*a* and 214*b* are pivoted to their first position at which they do not engage the projections 208*a* and 208*b*. The hold-back means 214*a*, 214*b* are pivoted back by means of a control unit, which is not shown. The hold-back means shown in FIG. 2 are therefore active hold-back means. When the hold-back means 214*a* and 214*b* have been pivoted to their first position, the portions 210*a* and 210*b* of the holding means are pressed onto the material contained in the tray due to the pretension in the direction of the reception tray. This engagement is maintained during the full period of rotation of the turning drum until the rotation is finished. When the rotation has been finished, the hold-back means 214*a* and 214*b* are moved to their second position at which they engage the projections 208*a* and 208*b*, whereby the engagement between said portions 210*a* and 210*b* and the turned material is eliminated so that the holding elements 108*a* and 108*b* will not obstruct a removal and a renewed supply, respectively.

Reference is made to the fact that, during the turning operation, only one of the trays of the turning drum shown in FIG. 2 will, of course, be filled, and that FIG. 2 shows the situation occurring when new material to be turned is supplied and when material which has already been turned is simultaneously removed.

On the basis of FIG. 3, a further embodiment of the present invention will be described hereinbelow, which uses an alternative structural design of the holding elements 108*a*, 108*b*. Elements which have already been described on the basis of FIGS. 1 or 2 are designated by the same reference numerals in FIG. 3. The holding elements 108*a* and 108*b* have essentially the same structural design so that only element 108*a* will be described, and the same reference numerals, having added thereto the letter b, will be used for element 108*b*.

Element 108*a* comprises first and second rollers 300*a*, 302*a* interconnected via a connecting member 304*a*. The rollers are supported such that they are spring-loaded and they are arranged parallel to the direction of transport of the material located in the reception tray 100. The rollers engage the material in the reception tray 100. This passive system is suitable for processing thin material. The roller system permits the material to be introduced in the drum and removed from the drum, a displacement of the material during the turning process being prevented by the blocking effect of a friction lining provided on said rollers 300*a*, 302*a*, since said rollers 300*a*, 302*a* are only movable in the direction of transport but not in the direction of rotation.

Figure 4:
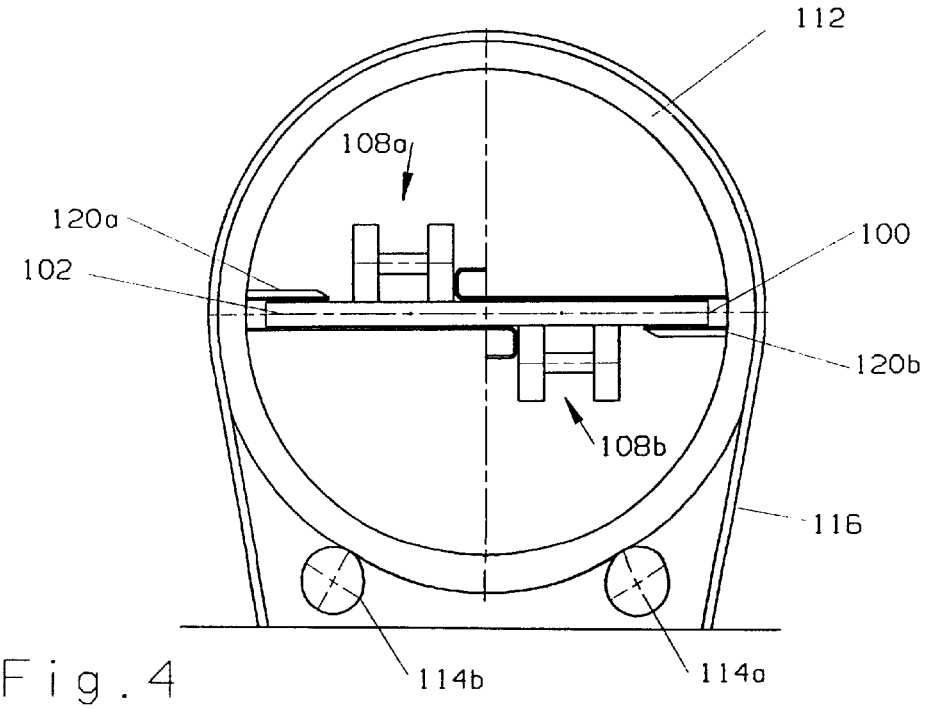
FIG. 4 shows a cross-sectional representation of a third embodiment of the present invention.

A further embodiment of the present invention is shown on the basis of FIG. 4, where only one tray is formed instead of the reception tray comprising an input and an output tray. An intermediate tray is not provided in this case. In this embodiment, the input tray is simultaneously the output tray. It only has to be guaranteed that the material introduced does not collide with the material removed. The advantage of this arrangement is to be seen in the fact that, in cases where the turning drum is intended to be used as a feed-through path, an adjustment of the removal means 106 will not be necessary. It follows that this embodiment provides the possibility of selectively determining by a control means in the course of an operation whether or not a material introduced is to be turned, without any mechanical changes at the turning device being required.

Although in the embodiments described hereinbefore, the holding means has been described as a means comprising two holding elements 108*a*, 108*b*, it is pointed out that one holding element would, in principle, suffice, e.g. in the case of the embodiment described in FIG. 4 where the reception tray 100 is not subdivided.

Figure 3:
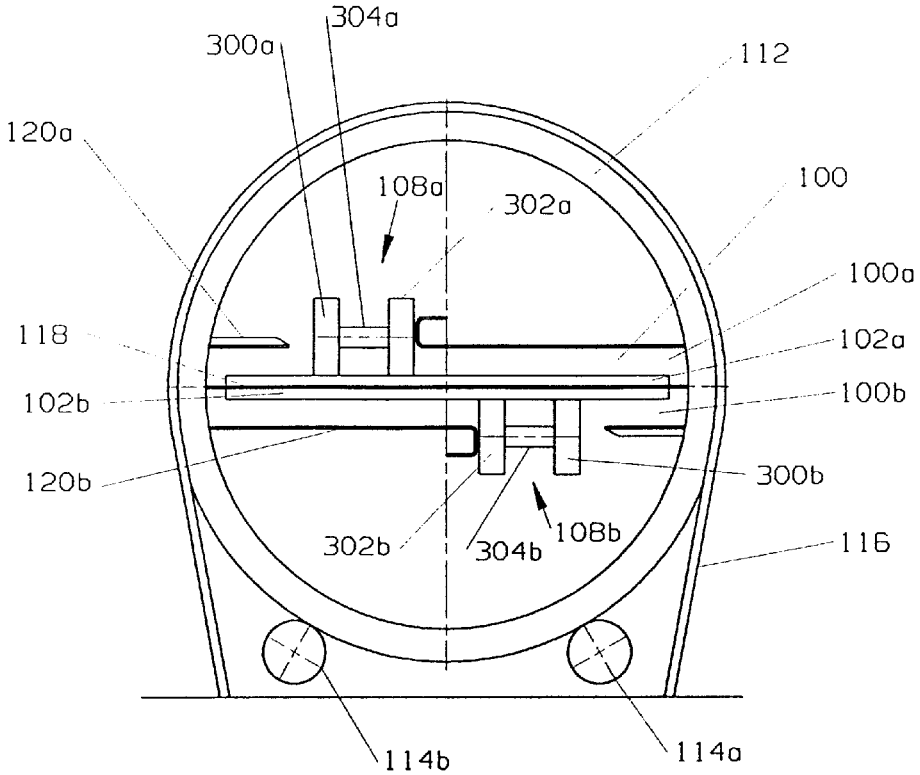
FIG. 3 shows a cross-sectional representation of a second embodiment of the present invention.

Furthermore, it is pointed out that the holding elements described hereinbefore are suitable for a two-tray turning drum of the type described on the basis of FIGS. 1 to 3 as well as for a single-tray turning drum of the type described on the basis of FIG. 4, i.e. the single-tray turning drum and also the two-tray turning drum can be equipped with an active as well as with a passive holding device.

What is claimed is:

1. A turning device, especially for turning paper material, comprising a reception tray used for receiving therein the material to be turned and arranged such that it is adapted to be rotated about an axis of rotation, the material being arranged in said reception tray in such a way that its axis of inertia during turning substantially coincides with the axis of rotation of said reception tray;

a means for feeding the material into the reception tray in the direction of the axis of rotation; and a means for removing the material from the reception tray in the direction of the axis of rotation; wherein when seen in a direction of transport of the material, the feed means is arranged at an adjustable distance ahead of the reception tray; and when seen in the direction of transport of the material, the removal means is arranged at a fixed distance behind the reception tray.

2. A turning device according to claim 1, wherein the removal means comprises two movably arranged members, which, for removing the material from the reception tray, are adapted to be moved into the area of rotation of the turning device whereupon they engage the material and remove it from the reception tray.

3. A turning device according to claim 2, wherein the two movable members of the removal means are adapted to be moved in such a way that said two movable members engage the material like a pair of tongs.

4. A turning device according to claim 1, comprising a holding means holding the material during the turning process.

5. A turning device according to claim 4, wherein the holding means comprises a pretensioned holding plate which engages the material to be turned, and a means which releases the engagement between said holding plate and the material when said material is being introduced in and removed from the reception tray.

6. A turning device according to claim 4, wherein the holding means comprises a spring-biased roller which is arranged parallel to the direction of transport of the material and which engages the material to be turned.

7. A turning device according to claim 4, wherein the holding means comprises two holding elements which are arranged such that the material to be turned, which is arranged in the reception tray, is arranged between said two holding elements, said holding elements engaging the material.

8. A turning device according to claim 1, comprising a drive means which is operatively connected to the reception tray and which causes the reception tray to rotate.

9. A turning device according to claim 1, comprising a drumshaped element having arranged therein the reception tray in such a way that the axis of rotation of the reception tray coincides with an axis of rotation of said drumshaped element, said drumshaped element being constructed such that the reception tray projects in the direction of the axis of rotation beyond the end faces of said drumshaped element, the holding means being arranged within said drumshaped element; and said drive means being operatively connected to the drumshaped element via a belt.

10. A turning device according to claim 1, wherein the reception tray comprises a first tray which is in alignment with the feed means and into which the material to be turned is introduced;

the reception tray comprises a second tray which is in alingment with the removal means and from which the material turned is removed; and the first tray becomes the second tray and the second tray becomes the first tray during a turning process when the turning device is in operation.

11. A turning device according to claim 1, comprising a control means causing the turning device to operate in a feed-through mode of operation in which the material introduced in the reception tray is not turned round, or a in a turning mode of operation in which the material introduced in the reception tray is turned round.

12. A turning device according to claim 1, wherein the material comprises paper, single sheets, loose packs and envelopes with or without content.

* * * * *